US010493314B1

(12) United States Patent
Lujan

(10) Patent No.: US 10,493,314 B1
(45) Date of Patent: Dec. 3, 2019

(54) WORKOUT APPARATUS FOR USE WITH A CHAIR

(71) Applicant: Andres M. Lujan, San Jose, CA (US)

(72) Inventor: Andres M. Lujan, San Jose, CA (US)

( * ) Notice: Subject to any disclaimer, the term of this patent is extended or adjusted under 35 U.S.C. 154(b) by 72 days.

(21) Appl. No.: 15/928,047

(22) Filed: Mar. 21, 2018

(51) Int. Cl.

| | |
|---|---|
| ***A63B 21/16*** | (2006.01) |
| ***A63B 21/04*** | (2006.01) |
| ***A63B 23/12*** | (2006.01) |
| ***A63B 21/00*** | (2006.01) |
| ***A63B 21/055*** | (2006.01) |
| ***A63B 23/035*** | (2006.01) |

(52) U.S. Cl.
CPC ..... *A63B 21/1609* (2015.10); *A63B 21/0442* (2013.01); *A63B 21/0557* (2013.01); *A63B 21/4035* (2015.10); *A63B 23/03541* (2013.01); *A63B 23/12* (2013.01)

(58) Field of Classification Search
CPC ..... A63B 21/1609; A63B 21/0557; A63B 23/03541; A63B 23/12; A63B 21/0442; A63B 21/4035; A63B 21/16
See application file for complete search history.

(56) References Cited

U.S. PATENT DOCUMENTS 2,560,404 A * 7/1951 Assmar ..... A61H 1/005 601/98
3,744,794 A * 7/1973 Gause ..... A63B 22/0605 482/57
5,141,482 A * 8/1992 Hern ..... A63B 21/0552 482/130
5,234,394 A * 8/1993 Wilkinson ..... A63B 21/055 482/121
5,324,243 A * 6/1994 Wilkinson ..... A63B 21/055 482/121
5,599,260 A * 2/1997 Rovinsky ..... A63B 21/0552 482/121
5,690,594 A * 11/1997 Mankovitz ..... A63B 23/03516 482/121
5,743,838 A 4/1998 Willis
5,921,900 A 7/1999 Mankovitz
6,013,014 A * 1/2000 Hern ..... A63B 21/0552 482/121

(Continued)

OTHER PUBLICATIONS

Internet products (miscellaneous), Dec. 15 2017, Internet, miscellaneous websites, U.S.

*Primary Examiner* — Andrew S Lo
(74) *Attorney, Agent, or Firm* — Richard A. Ryan

(57) ABSTRACT

A workout apparatus that is secured to an office chair to allow a person sitting in the chair to utilize the workout apparatus to exercise while he or she is sitting in the chair. The workout apparatus has a back plate assembly secured to the back of the chair, a post strap assembly secured around the center post of the chair that connects the base of the chair to the seating section of the chair, a connecting strap assembly that connects the back plate and post strap assemblies, a support strap that secures the back plate assembly to the chair and one or more exercise components that are attached to the back plate assembly. Preferably, all of the components of the workout apparatus are removably connected to each other for ease of installation and flexibility with regard to exercises. The exercise components have handles attached to a resistance band.

20 Claims, 8 Drawing Sheets

(56) References Cited

U.S. PATENT DOCUMENTS 6,099,445 A * 8/2000 Rovinsky ..... A63B 21/0552 482/121
6,117,056 A * 9/2000 Cataldi, Jr. ..... A63B 21/0552 482/121
6,461,283 B1 * 10/2002 Maron ..... A63B 21/023 482/123
6,500,104 B1 * 12/2002 Rich ..... A63B 21/04 482/123
7,077,792 B2 * 7/2006 Nerenberg ..... A63B 21/02 482/121
7,083,555 B1 * 8/2006 McPartland ..... A63B 21/0552 482/140
7,137,935 B2 11/2006 Clarke et al.
7,699,762 B2 * 4/2010 Turnbull ..... A63B 21/04 482/130
8,162,809 B1 * 4/2012 Eastwood ..... A63B 21/0552 482/123
8,696,531 B1 * 4/2014 Spiller ..... A47C 9/002 482/129
8,876,676 B2 11/2014 Lalaoua
9,220,350 B2 12/2015 Best et al.
9,282,829 B2 * 3/2016 Caruso ..... A47C 21/00
9,409,501 B2 * 8/2016 Henry ..... A63B 21/00069
9,795,820 B2 10/2017 VanHorn et al.
2003/0158024 A1 * 8/2003 Saure ..... A63B 21/0552 482/126
2005/0233875 A1 * 10/2005 Clarke ..... A63B 21/00043 482/123
2006/0052224 A1 * 3/2006 Kellogg ..... A63B 21/0552 482/130
2006/0281612 A1 * 12/2006 Bendavid ..... A47C 7/62 482/148
2007/0099780 A1 * 5/2007 Bowser ..... A63B 21/00043 482/148
2008/0004166 A1 * 1/2008 Oren ..... A63B 21/0442 482/142
2008/0039301 A1 * 2/2008 Halbridge ..... A63B 21/026 482/121
2008/0081748 A1 * 4/2008 Knapp ..... A63B 21/0552 482/130
2008/0214369 A1 * 9/2008 Mancini ..... A63B 21/04 482/121
2008/0220953 A1 * 9/2008 Bowser ..... A63B 21/04 482/130
2008/0254955 A1 * 10/2008 Mongelluzzo ..... A47C 9/002 482/138
2008/0261787 A1 * 10/2008 Smith ..... A47C 7/62 482/130
2009/0017999 A1 * 1/2009 Halbridge ..... A63B 21/026 482/130
2009/0048082 A1 * 2/2009 Abbott ..... A63B 23/0211 482/140
2009/0163336 A1 * 6/2009 Mueller ..... A47C 31/11 482/129
2009/0233773 A1 * 9/2009 Cardey ..... A63B 21/0552 482/121
2010/0323861 A1 * 12/2010 Karwan ..... A47C 7/40 482/145
2014/0045663 A1 * 2/2014 Dyderski ..... A63B 21/4043 482/142
2015/0209608 A1 * 7/2015 Hernandez ..... A63B 21/0442 482/123
2015/0258367 A1 * 9/2015 Tayebi ..... A63B 23/0355 482/124
2015/0314162 A1 * 11/2015 Mueller ..... A63B 21/16 482/129
2016/0016030 A1 * 1/2016 Stout ..... A63B 21/0442 482/130
2016/0263420 A1 * 9/2016 DuMee ..... A63B 21/0552
2016/0354629 A1 * 12/2016 Salamon ..... A63B 21/00185

* cited by examiner

WORKOUT APPARATUS FOR USE WITH A CHAIR

CROSS-REFERENCE TO RELATED APPLICATIONS

None.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The present invention relates generally to apparatuses utilized for exercise and to improve the user's health. In particular, the present invention relates to such apparatuses that are configured to be utilized with a chair to allow the user to easily and conveniently exercise while he or she is sitting in the chair. Even more particularly, this invention relates to such apparatuses that connect to a chair having a back portion and a center post, with the apparatus configured to connect to these components so the user can utilize the apparatus to exercise while he or she is sitting in the chair.

B. Background

Many people exercise to improve their health and fitness levels and as a method to control their weight or to lose weight. Any type of exercise activity that can reasonably accomplish these objectives requires a person to engage in some type of physical activity that utilizes the person's muscles to improve his or her cardio operation and oxygen intake. To assist with improving health, fitness and/or weight loss, many people walk, run, bike, kayak or engage in similar motion or sports activities and/or they utilize specially configured exercise equipment, such as weight benches, treadmills, elliptical machines, stair climbers and the like, that allow the user to effectively and efficiently target the area or areas of their body they wish to strengthen and to allow the user to improve his or her cardio and lung operation. Many of the above exercises are generally done in outdoor areas, home gyms and/or fitness centers where there is the space, area and/or equipment to accomplish the exercise objectives.

Although a person who participates in the above activities one or more times during the day is more likely to be able achieve his or her health and fitness objectives, most people have relatively long periods of time where they are at work and are not able to participate in such activities. In particular, people who tend to spend most of their work day sitting in a chair while they work at a desk, often in front of a computer screen, will generally have long periods of time of inactivity when they get little to no meaningful exercise. Despite the fact that many health and fitness experts recognize that these long periods of time where a person is primarily sitting in a chair are not conducive to a healthy lifestyle, most people have no choice but to be at their desk during the majority of the work day. Some work organizations have recognized the health problems associated with these long periods of inactivity and have implemented programs where the employees take short but frequent breaks to stretch or otherwise move, usually at or near their workstation. Most workers, however, do not have such breaks and do not have the ability to be away from their desks to exercise or otherwise engage in activities that will help improve their health and fitness.

The typical gym equipment is too large and, very often, too heavy to be of any use to the worker who works at a desk. The availability of easily portable exercise equipment that can be brought to work and then accessed and utilized by the worker while at his or her desk are significantly limited. In addition, most such portable exercise equipment will take up too much space in the usually somewhat limited area around his or her desk to be able to be stored out of the way when the equipment is not in use. Recognizing that people who sit in a chair and work at their desk for most of the day have few options available to them to improve their health and fitness, equipment has been developed that allows a person to exercise at his or her desk while sitting in his or her chair. Some of this equipment allows the user to move his or her feet and leg below the desk. Other equipment is attached to or incorporated into the office furniture so the worker can utilize the equipment to exercise when it is most convenient for him or her while sitting in his or her office chair.

One example of exercise equipment that is available is described in U.S. Pat. No. 7,137,935 to Clarke, et al. as an office gym exercise kit. This kit includes a number of components, some of which attach to an office chair, that allows the user to perform various exercises. In one configuration, a flexible member is wrapped around the center post that connects the base of the chair to the chair seat and the elastic bands are directly connected to the flexible member. While sitting in the chair, the user grasps the elastic bands and extends his or her arms in a generally forward or outward directions to pull on the elastic bands. Resistance from the elastic bands, which results from the weight of the user in the chair, exercises his or her arms and provides cardio benefits. U.S. Pat. No. 5,921,900 to Mankovitz also describes an exercise apparatus having a wheeled foot bar that attaches to an office chair by a plurality of elastic bands to allow the user exercise his or her legs by pushing against the foot bar. U.S. Pat. No. 5,743,838 to Willis describes an exercise system having a flexible body that is wrapped around the back of the chair and an elastic member that attaches to the flexible body. The user engages the elastic member to exercise an arm or leg. U.S. Pat. No. 8,876,676 to Lalaoua and U.S. Pat. No. 9,220,350 to Best, et al. describe fitness chairs that comprise a plurality of elastic bands that are attached to the frame or other portion of the chair. U.S. Pat. No. 9,795,820 to VanHorn, et al. describes a chair-based workout apparatus having a support frame that couples to the support post of an office chair. Rotatable arms are pivotally connected to the support frame and one or more resistance members are connected to the arms to provide resistance to movement by the user's arms or legs. A wide variety of other devices are commercially available to persons who want to be able to exercise while sitting in his or her office chair. Some of these devices are incorporated into the chair and others removably attach to the chair, typically to the upright back support portion of the chair. Most such devices utilize one or more elastic bands that are grasped by the user's hands or engaged by his or feet and then pulled on by the user to exercise his or her arms and/or legs.

Unfortunately, many of the prior art chair-based workout apparatuses are too bulky to be utilized in most office or like environments, too costly for the average office worker to afford and/or impractical for the user to quickly and easily utilize for exercise. As a result, what is needed is an improved workout apparatus that can be utilized with an office chair to allow the person sitting in the chair to exercise his arms and legs in a way that benefits his or her health and fitness levels. The improved workout apparatus should be structured and arranged to attach to an office chair in a manner that allows the user to exercise various parts of his or her body while sitting in the chair. Preferably, the workout apparatus would be easy to attach to an office chair and configured so as to not interfere with the user's ability to sit in and move the chair. The new workout apparatus should also be configured such that it will not take up a lot of space around the chair or interfere with the user's ability to work at his or her desk. An improved workout apparatus should be easily adaptable to a variety different office chair designs. The new workout apparatus should also be able to provide a variety of different types of exercises for the user. Preferably, the new workout apparatus is relatively inexpensive to manufacture.

SUMMARY OF THE INVENTION

The workout apparatus of the present invention provides the benefits and solves the problems identified above. That is to say, the workout apparatus of the present invention is specially structured and arranged to attach to an office type of chair and allow a person to utilize the apparatus to exercise one or more parts of his or her body. Utilizing the new workout apparatus, a person can easily, quickly and effectively perform a variety of exercises while he or she is sitting in his or her chair that will help the user improve his or her health and fitness. The workout apparatus of the present invention is structured and arranged to securely attach to an office chair of the type having an upright center post that interconnects the base and the seating section of the chair in a manner that allows the user to exercise various parts of his or her body while he or she is sitting in the chair. In the preferred configuration of the present invention, the new workout apparatus is very easy to attach to an office chair and the apparatus is configured to not interfere with the user's ability to sit in and move the chair. The new workout apparatus is configured such that it will not take up much space around the office chair and it will not interfere with the user's ability to work at his or her desk. In the preferred embodiments, the new workout apparatus is readily adaptable to a wide variety of different office chair designs. Once attached to an office chair, the user merely has to grasp portions of the new workout apparatus, extend his or her arms upward, forward and/or outward to begin exercising. The user can also rotate the new exercise apparatus around to the front of the office chair, stand on a portion of the apparatus to accomplish different types of exercises. In a preferred configuration of the present invention, the new workout apparatus is relatively inexpensive to manufacture.

In one embodiment of the present invention, the exercise apparatus generally comprises a mounting assembly and one or more exercise components, with the mounting assembly being structured and arranged to secure the exercise apparatus to an office chair having a seating section, a base and a center post interconnecting the base and the seating section. The mounting assembly has a back plate assembly that is sized and configured to be positioned at a back surface of a chair back of the seating section, a post strap assembly that is sized and configured to be positioned at the center post, a connecting strap assembly that is sized and configured to connect the post strap assembly to the back plate assembly and a support strap that is sized and configured to secure the back plate assembly to the chair back of the seating section. The exercise components are attached to the mounting assembly to allow a user to exercise while he or she is sitting in the office chair. Each of the exercise components comprise a handle that is attached to a resistance band. The back plate assembly has a back plate with one or more strap connectors that are each configured to be engaged by the support strap. The support strap has an elongated support strap member and a support strap connector at an end of the support strap member, with the support strap connector being sized and configured in corresponding relation with the strap connector of the back plate assembly to easily and quickly connect thereto. In a preferred configuration, the back plate is flexible and the support strap is structured and arranged to place the back plate in abutting relation against the back surface of the chair back of the office chair. Also in a preferred configuration, the back plate has two of the strap connectors and the support strap has a support strap connector at each end of the support strap member, with each one of the support strap connectors being configured to engage one of the strap connectors on the back plate to secure the back plate assembly and the support strap to the chair back of the office chair.

The back plate of the back support assembly also has at least one connecting strap ring. The connecting strap assembly has a connecting strap with at least one back plate connector that is configured to engage the connecting strap ring so as to connect the connecting strap to the back plate. In a preferred configuration, the connecting strap of the connecting strap assembly is Y-shaped, the connecting strap assembly has at least two of the back plate connectors, and the back plate has at least two of the connecting strap rings.

The post strap assembly has an elongated post strap member that is sized and configured to encircle the center post of the office chair so as to be secured around the center post of the office chair when the workout apparatus is attached to the office chair. In a preferred configuration, the post strap assembly has a strap ring at each end of the post strap member and the connecting strap assembly has a post strap connector that is structured and arranged to engage each of the strap rings to secure the post strap assembly around the center post of the office chair.

Each of the resistance bands has an elongated resistance band member with a resistance connector at one end of the resistance band member to removably connect the resistance band member to the back plate assembly. The back plate assembly comprises a back plate having at least one exercise ring sized and configured to removably connect to the resistance connector. Preferably, the back plate has a plurality of exercise rings for connecting a plurality of resistance bands to the back plate assembly and each of the resistance band members has one of the resistance connectors at each end of the resistance band member to removably connect the resistance band to each of the handle and the back support assembly.

Accordingly, the primary object of the present invention is to provide a new workout apparatus for use with a chair that has the advantages set forth above and which overcomes the various disadvantages and limitations which are associated with presently available chair-based workout apparatuses.

It is an important object of the present invention to provide a new workout apparatus that is specifically structured and arranged to removably attach to an office chair and allow the person sitting in the chair to exercise one or more parts of his or her body in a manner which improves the user's overall health and fitness.

It is also an important object of the present invention to provide a new workout apparatus that is easy to attach to an office chair, easy to use, effective at improving the user's health and fitness, adaptable to a variety of different office chair designs and sized to be suitable for use in an office or other locations.

An important aspect of the present invention is that it provides a new workout apparatus that accomplishes the objectives set forth above and elsewhere in the present disclosure.

Another important aspect of the present invention is that it provides an improved workout apparatus which is structured and arranged to be attached to an office chair and be easily, quickly and effectively utilized by a person to exercise one or more parts of his or her body in a manner that benefits the user's health and fitness.

Another important aspect of the present invention is that it provides an improved exercise apparatus having a mounting assembly which is structured and arranged to securely attach to the center post that interconnects the base and seat portion of an office chair in a manner that allows the user to exercise various parts of his or her body while he or she is sitting in the chair.

Another important aspect of the present invention is that it provides an improved exercise apparatus which is easy to attach to an office chair, does not interfere with the user's ability to sit in and move the chair around his or her workstation or other areas, does not take up a significant amount of space around the office chair and does not interfere with the user's ability to work at his or her desk or other area around the work chair.

Another important aspect of the present invention is that it provides an improved exercise apparatus for use with office chairs which is readily adaptable for attachment to and use with a wide variety of different office chair designs.

Yet another important aspect of the present invention is that it provides an improved exercise apparatus for use with office chairs which, in the preferred configurations, is relatively inexpensive to manufacture.

As will be explained in greater detail by reference to the attached figures and the description of the preferred embodiments which follow, the above and other objects and aspects are accomplished or provided by the present invention. As set forth herein and will be readily appreciated by those skilled in the art, the present invention resides in the novel features of form, construction, mode of operation and combination of processes presently described and understood by the claims. The description of the invention which follows is presented for purposes of illustrating one or more of the preferred embodiments of the present invention and is not intended to be exhaustive or limiting of the invention. The scope of the invention is only limited by the claims which follow after the discussion.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

Figure 1:
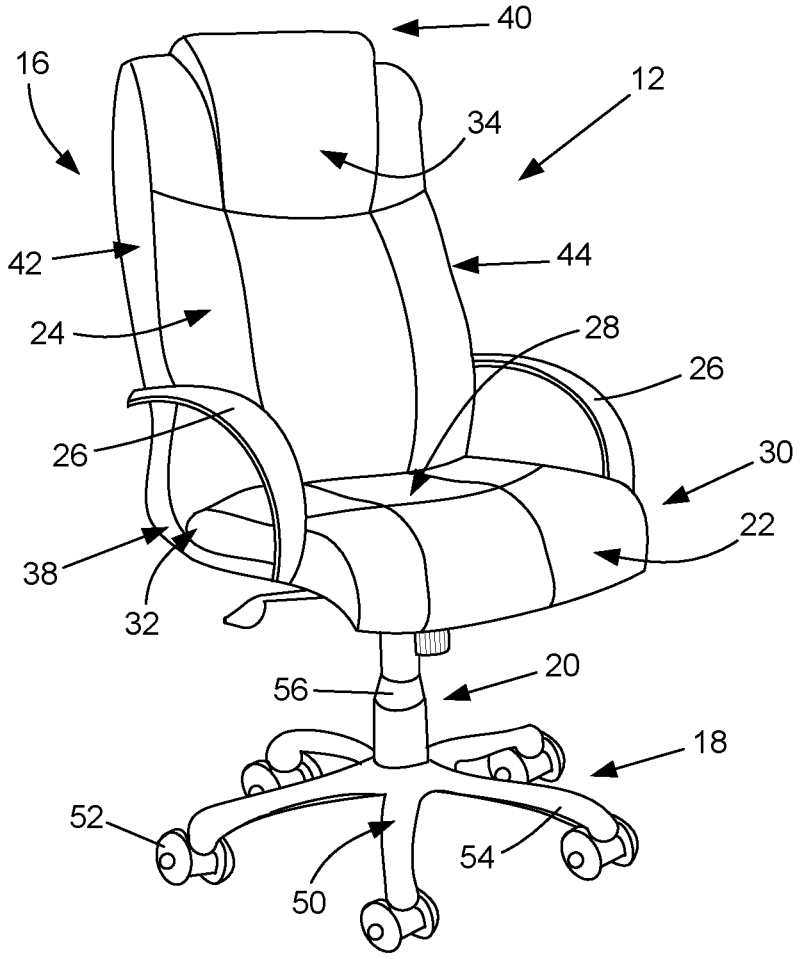
FIG. 1 (PRIOR ART)
FIG. 1 is a front perspective view a prior art office chair which can be utilized with the workout apparatus of the present invention.

With reference to the figures where like elements have been given like numerical designations to facilitate the reader's understanding of the present invention, the preferred embodiments of the present invention are set forth below. The enclosed figures are illustrative of several potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show particular materials, shapes and configurations for the various components of the workout apparatus of the present invention, as well as examples of an office chair with which the new workout apparatus may be utilized and one or more exercises that can be done with the new workout apparatus, those skilled in the art will readily appreciate that the present invention is not so limited. In addition, the exemplary embodiments of the present workout apparatus is shown and described herein with only those components that are required to disclose the present invention. As such, it may be possible that some of the necessary elements for attaching and using the present invention are not shown or necessarily described below, but which are well known to persons who are skilled in the relevant art. As will be readily appreciated by such persons, the various elements of the present invention that are described below may take on any form consistent with forms that are readily realized by a person of ordinary skill in the art having knowledge of workout apparatuses, office chairs and chair-based exercises.

A workout apparatus tool that is configured pursuant to one or more of the preferred embodiments of the present invention is referred to generally as 10 in FIGS. 2-4 and 12-13. As set forth below, the new workout apparatus 10 of the present invention is structured and arranged to, preferably, removably attach to an office chair 12, such as the exemplary office chair shown as 12 in FIGS. 1-3 and 12-13, so the person sitting in the chair 12 (referred to as the user 14 shown in FIG. 12) can perform one or more exercises to improve his or her health and fitness. As well known in the art, an office chair 12 is commonly configured with a seating section 16, a base 18 and a center post 20 interconnecting the base 18 and seating section 16 so as to position the seating section 16 above the base 18, as best shown with regard to the exemplary prior art office chair 12 in FIG. 1. The base 18 of most office chairs 12 are configured to allow the user 14 to move the office chair 12 across the floor or other surface on which the chair 12 sits. For purposes of the present invention, the term "office chair" refers to any type of chair that has the basic components described above so the new workout apparatus 10 can attach to the center post 20 of the office chair 12 and the user 14 can sit in the seating section 16 and utilize the workout apparatus 10 to exercise, as set forth in more detail below. As will be readily appreciated by persons who are skilled in the relevant art, the center post 20 may or may not be utilized as a support post and the office chair 12 may be utilized for a wide variety of non-work and non-office uses, including leisure activities such as relaxing, watching television, reading and the like.

Figure 2:
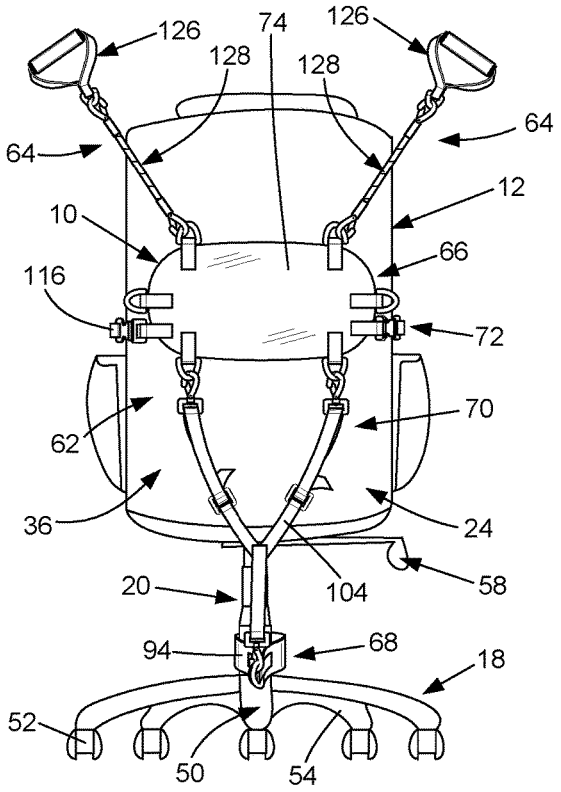
FIG. 2 is a back view of the prior art office chair of FIG. 1 having a workout apparatus that is configured according to a first embodiment of the present invention shown attached to the office chair.
Figure 3:
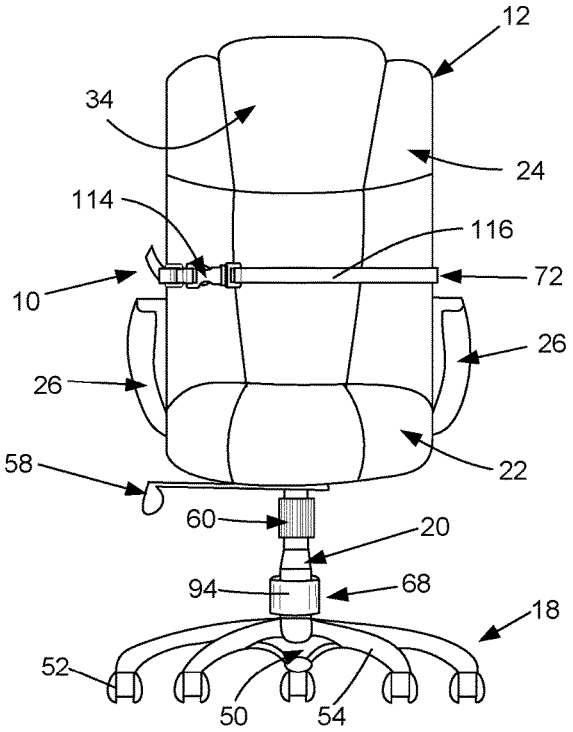
FIG. 3 is a front view of the prior art office chair of FIG. 1 having the workout apparatus of FIG. 2 shown attached thereto.

The seating section 16 of a typical office chair 12 comprises a chair seat 22, chair back 24 and a pair of arm rests 26 on either side of the chair seat 22, as best shown in FIG. 1. The chair seat 22 has an upper surface 28 upon which the user 14 sits, a front end 30 and a back end 32. The chair back 24, which may or may not be connected to, integral with or even in abutting relation to the chair seat 22, has a front surface 34, a back surface 36, a lower end 38, an upper end 40, a first/left side 42 and a second/right side 44, as best shown in FIGS. 1-3. In the embodiment of the office chair 12 shown in the figures, the lower end 38 of the chair back 24 abuts the chair seat 22 and both the chair seat 22 and chair back 24 are solid. In other embodiments, the lower end 38 may be in spaced apart relation above the chair seat 22 and one or both of the chair seat 22 and chair back 24 may be made out of mesh or in other non-solid configurations. In a typical use of the office chair 12, the user 14 sits on the chair seat 22 and positions his or her back at or near the front surface 34 of the chair back 24 with his or her arms resting on the arm rests 26. In some configurations, the office chair 12 may not have the arm rests 26 that are shown in the figures. Such a configuration does not affect the ability of the workout apparatus 10 to attach to the office chair 12 or the use of the workout apparatus 10 by the user 14.

As set forth above, for purposes of describing the workout apparatus 12 of the present invention and the use thereof, the office chair 12 may be any type of chair having the seating section 16, base 18 and center post 20, whether or not these components are configured as shown in the accompanying figures. In addition, for purposes of describing the use and relative location of the various components and the use of the present invention, the terms "front", "forward", "forwardly" and the like are utilized to refer to the direction of the front end 30 of the chair seat 22 and the direction the user 14 faces when he or she is (normally) sitting on the seating section 16 of the office chair 12, the terms "back", "rearward", "rearwardly" and the like are utilized to refer to the direction of the back end 32 of the chair seat 22 and chair back 24 of the office chair 12, and the terms "upward", "upwardly", "upper", "top" and the terms "downward", "downwardly", "lower", "bottom" and the like refer to the direction, respectively, of the upper end 40 and the lower end 38 of the chair back 24 and the position user's head 46 and his or her feet 48 of the user 14 when he or she is sitting normally in the seating section 16 of the office chair 12.

The base 18 of the typical office chair 12 is structured and arranged to moveably support the office chair 12 and user 14 on a floor or other surface and comprises a base frame 50 and a plurality of wheels 52 that are attached to or integral with the base frame 50. The typical base frame 50 has a plurality of frame members 54 that extend outward from the center of the base frame 50. The wheels 52, which are often configured as casters, are usually positioned at or near the outward end of the frame members 54 of the base frame 50, as shown in FIGS. 1-3 and 12-13.

As set forth above, for a typical office chair 12, the center post 20 is structured and arranged to interconnect the base 18 and the seating portion 16 in a manner that safely supports the seating portion 16 above the base 18, as shown in FIGS. 1-3 and 12-13. The center post 20 typically comprises one or more post members 56. In a common configuration, the center post 20 has at least two tubularly shaped post members 56 that are telescopically arranged to allow the user 14 to adjust the height of the seating section 16, particularly the chair seat 22 upward or downward, as may be desired by the user 14 (typically based on his or her height or leg length) to keep his or her feet 48 on or above the floor.

The typical office chair 12 has a vertical adjustment mechanism 58 that is cooperatively connected to the center post 20 to allow the user 14 to adjust the height of the seating section 16 upward or downward. The typical office chair 12 also has a seat angle adjustment mechanism 60 that allows the user 14 to adjust the angle of the chair seat 22 from its front end 30 to the back end 32. As well known in the art, some people prefer the front end 30 of the chair seat 22 being higher or lower relative to the back end 32 thereof.

Figure 4:
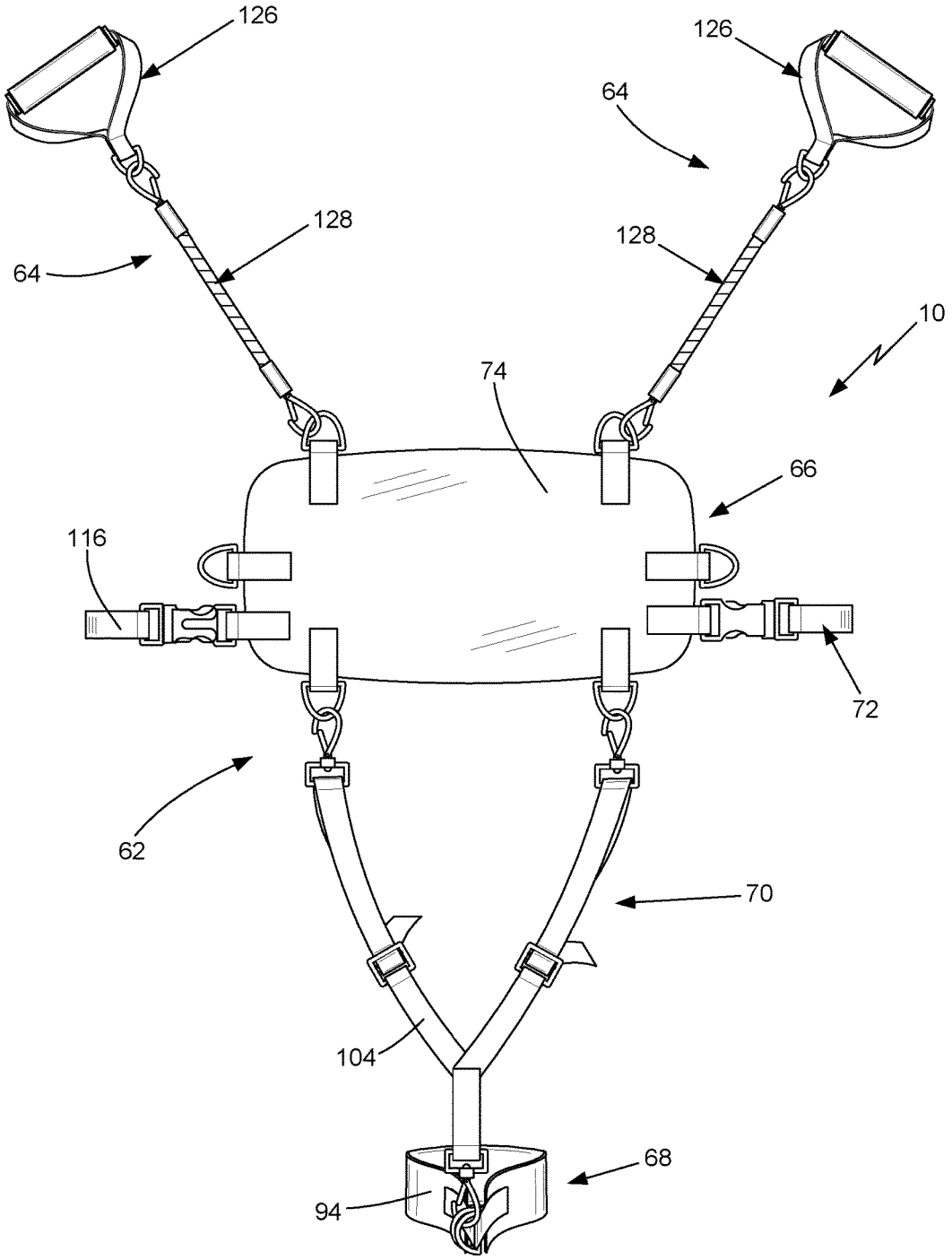
FIG. 4 is a back view of the workout apparatus of FIG. 2 shown separate from the office chair.
Figure 5:
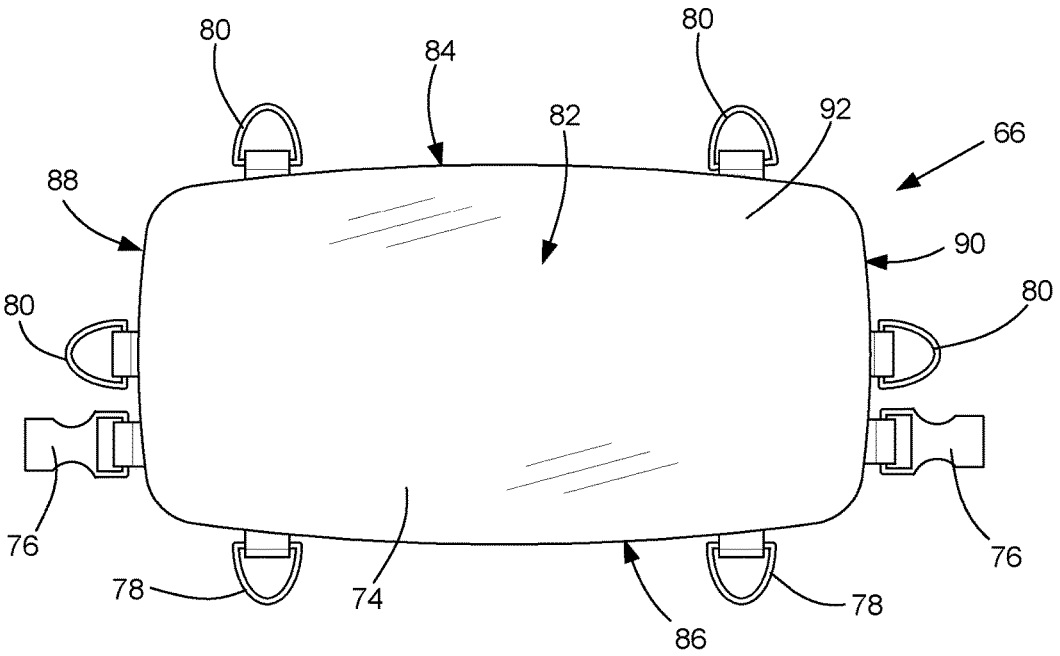
FIG. 5 is a front view of the back plate assembly of the workout apparatus of FIG. 4.
Figure 6:
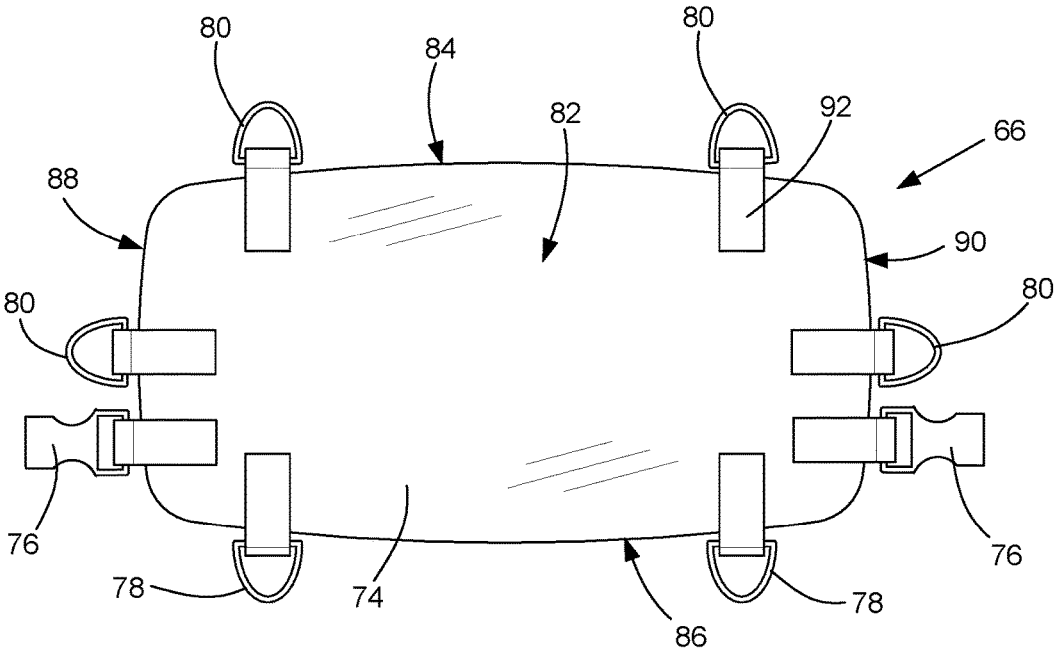
FIG. 6 is a back view of the back plate assembly of the workout apparatus of FIG. 4.

The workout apparatus 10, which is structured and arranged to be utilized with the office chair 12 by the user 14 to improve his or her health and fitness, generally comprises a mounting assembly 62 and one or more exercise components 64, as best shown in FIG. 4. The mounting assembly 62 has a back plate assembly 66 that is secured to the chair back 24 of the office chair 12, a post strap assembly 68 that is secured to the center post 20 around the one or more support members 56 thereof, a connecting strap assembly 70 that interconnects the back plate assembly 66 and the post strap assembly 68 and a support strap 72 that secures the back plate assembly to the chair back 24, as best shown in FIGS. 2 and 5-6. As set forth in more detail below, back plate assembly 66, post strap assembly 68, connecting strap assembly 70 and support strap 72 cooperate together to adjustably secure the workout apparatus 10 to the office chair 12 so the user 14 can utilize the workout apparatus 10 to exercise while in office chair 12.

In a preferred configuration, the back plate assembly 66 comprises a back plate 74 that is positioned against the back surface 36 of the chair back 24 (or against the floor in one use), at least one strap connector 76 for connecting to the support strap 72, at least one connecting strap ring 78 for connecting to the connecting strap assembly 70 and at least one exercise connecting ring 80 for connecting to the exercise components 64, as best shown in FIGS. 4-6. In the embodiment shown in the figures, the back plate assembly 66 comprises two strap connectors 76, two connecting strap rings 78 and four exercise connecting rings 80. The configuration and use of these components are set forth in more detail below. The back plate 74 can be made out of wide variety of materials, including certain metals. In the preferred embodiments, however, the back plate 74 is made out of a flexible, strong material, such as certain cloth or cloth-like materials (such as canvas or the like), leather, mesh or the like so the back plate 74 will at least substantially conform to the shape of the back surface 36 of chair back 24 (with the term "substantially" being used in this context to mean the back surface 36 of back plate 74 is in or at least nearly in complete abutting relation with the back surface 36 of the chair back 24). Back plate 74 has a center portion 82 that is bounded by a top edge 84, bottom edge 86, first/left side edge 88 and a second/right side edge 90, as best shown in FIGS. 5-6.

Although the strap connectors 76, connecting strap rings 78 and exercise connecting rings 80 can be positioned anywhere on the back plate 74, in a preferred configuration, one strap connector 76 is positioned at or near each of the first side edge 88 and second side edge 90, the connecting strap rings 78 are positioned at or near the bottom edge 86, one exercise connecting rings 80 are positioned at or near each of the first side edge 88 and second side edge 90 and two of the exercise connecting rings 80 are positioned at or near the top edge 84, as best shown in FIGS. 5-6. As will be readily appreciated by persons skilled in the art, in a common configuration, each of the connectors 76 and rings 78/80 are secured to the center portion 82 of the back plate 74 by small attachment straps 92 that interconnects, each individually or separately, the connectors 76 and rings 78/80 to the back plate 74. In one embodiment, the attachment straps 92 are sewn to the back plate 74 using sewing techniques, familiar to those skilled in the art, that substantially fixedly attaches the attachment straps 92 to the back plate 74. The connectors 76 and rings 78/80 are securely attached to the attachment straps 92. In other embodiments, the attachment straps 92 can be integral with the back plate 74 of the attachment straps 92 can be removably attached to the back plate 74 using appropriately configured connectors, such as snaps, buttons, hook and loop material (i.e., Velcro®), ties or the like.

The strap connectors 76, which are utilized to connect to the support strap 72, are configured in corresponding relation to the end or ends of the support strap 72. In one embodiment, the strap connectors 76 can be rings that are engaged by clips at the ends of the support strap 72. In the embodiment shown in the figures, there are two strap connectors 76 are one half of a side release or snap buckle and the other half of the side release or snap buckle is attached to the ends of the support strap 72, as described below and best shown in FIG. 9. In another embodiment, the one end of the support strap 72 can be integral with or fixedly attached to the back plate 74, requiring only a single strap connector 76 and only one end of the support strap 72 having a connector that is configured in corresponding relation to the strap connector 76. Typically, the side release buckle strap connectors 76 are made out of a strong, stiff plastic material. Although side release buckles have certain advantages with regard to ease and quickness of use, persons who are skilled in the relevant art will readily appreciate that a wide variety of different types of strap connectors 76 can be beneficially utilized with the back plate assembly 66 of the new workout apparatus 10.

The connecting strap rings 78 and exercise connecting rings 80 can be made out of virtually any material which is strong so as to provide rings 78/80 that are sufficiently strong and stiff enough for the forces that will arise during use of the new workout apparatus 10 and which are configured in virtually any ring-like shape to connect to their respective components. In a preferred embodiment, the connecting strap rings 78 and exercise connecting rings 80 are made out of metal. In the embodiment shown in the figures, each of the connecting strap rings 78 and exercise connecting rings 80 are D-rings (although these components do not necessarily need to be the same).

Figure 7:
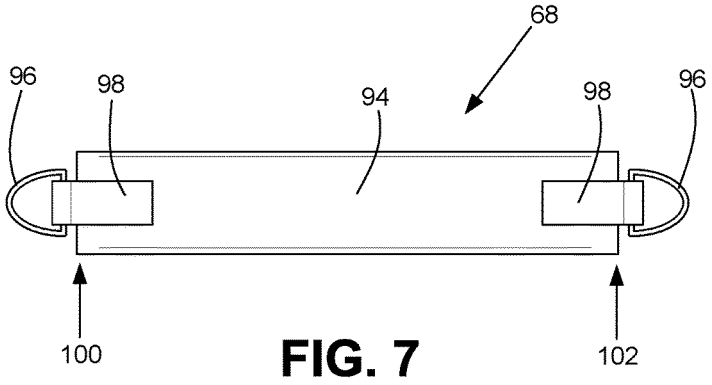
FIG. 7 is a back view of the post strap assembly of the workout apparatus of FIG. 4.

The post strap assembly 68, which is best shown in FIG. 7, has an elongated post strap member 94 that is made out of materials which allow the strap member 94 to be sufficiently flexible so it can be formed into a tubular shape and wrapped around (in a cuff-like manner) the center post 20 of the office chair 12, as best shown in FIGS. 2-3. The post strap assembly 68 also comprises a pair of strap rings 96 that are attached to strap member 94 with small attachment straps 98 (the same as or similar to attachment straps 92), with one strap ring 96 at or near the first end 100 of the strap member 94 and the other strap ring 96 at or near the second end 102 of the strap member 94, as best shown in FIG. 7. If desired, each end 100/102 of the strap member 94 can have a plurality of strap rings 96 (though one will generally be sufficient). Because the post strap assembly 68 will be secured around the center post 20 and utilized to help secure the workout apparatus 10 to the office chair 12, the materials utilized for the strap member 94, strap rings 96 and attachment straps 98 (as well as the process utilized to secure the attachment straps to the strap member 94) should be chosen to be sufficiently strong to ensure that the post strap assembly 68 will not break apart during use of the workout apparatus 10. In one embodiment, the strap member 94 is made out of the same or a similar material to the back plate 74 and the attachment straps 98 are attached to the strap member 94 by sewing them thereto in a manner which substantially fixedly attaches the attachment straps 98 to the strap member 94. The strap rings 96 can be D-rings which are securely attached to the attachment straps 98.

Figure 8:
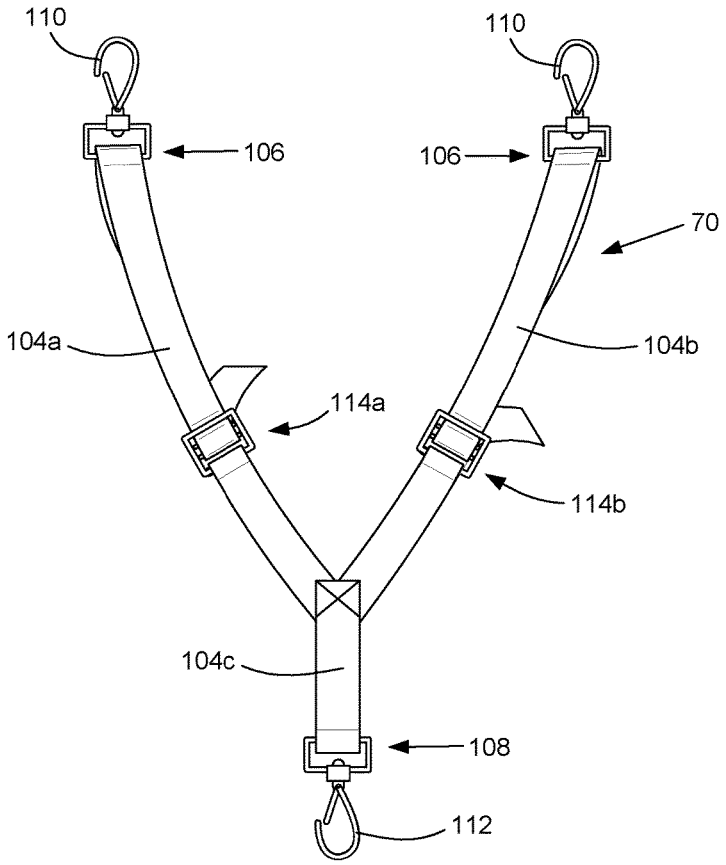
FIG. 8 is a back view of the connecting strap assembly of the workout apparatus of FIG. 4.

The connecting strap assembly 70 generally comprises a connecting strap 104 having a first end 106 and a second end 108, with back plate connectors 110 at the first end 106 and a post strap connector 112 at the second end 108, as best shown in FIG. 8. Although the connecting strap 104 can be a single elongated strap, in the preferred configuration the connecting strap 104 has a generally Y-shaped configuration, shown with connecting straps 104*a*, 104*b* and 104*c*, to better hold the back plate assembly 66 in place against the back surface 36 of the chair back 24, as shown in FIG. 2. The connecting strap 104 can be made out of variety of non-elastic materials, including canvas and the like (or other materials commonly utilized for straps). To allow the user 14 to adjust the length of the connecting straps 104*a*/104*b*, the connecting strap assembly 70 has a pair of adjustable slider buckles 114 associated with each connecting strap 104*a*/104*b* (with the slider buckles 114 shown as 114*a* and 114*b* in FIG. 8). The configuration and use of the slider buckles 114 are well known in the art. The back plate connectors 110 at the first ends 106 of connecting strap 104*a* and 104*b* are selected so as to be cooperatively configured with the connecting strap rings 78 of the back plate assembly 66 so they can be removably (in a preferred configuration) attached to the connecting strap rings 78. In one embodiment, the back plate connectors 110 are metal clips or clasps that are of the type that can be opened or otherwise operated to engage the connecting strap rings 78. The post strap connector 112 at the second end 108 of the connecting strap 104 is cooperatively configured with the strap rings 96 at the ends of the strap member 94 so it can be removably engaged (in a preferred configuration) with the strap rings 96. In the embodiment shown in the figures, the post strap connector 112 is of the type that can be opened or otherwise operated to engage the two strap rings 96 together to secure the strap member 94 in its columnar or cuff-like configuration around the center post 20, as shown in FIG. 2. In a preferred embodiment, the back plate connectors 110 and the post strap connector 112 are the same type of connectors. The three connecting straps 104*a*/104*b*/104*c* are joined together to form the desired y-shaped configuration. In one embodiment, these connecting straps 104*a*/104*b*/104*c* are connected by utilizing sewing techniques that are well known to persons skilled in the art.

Figure 9:
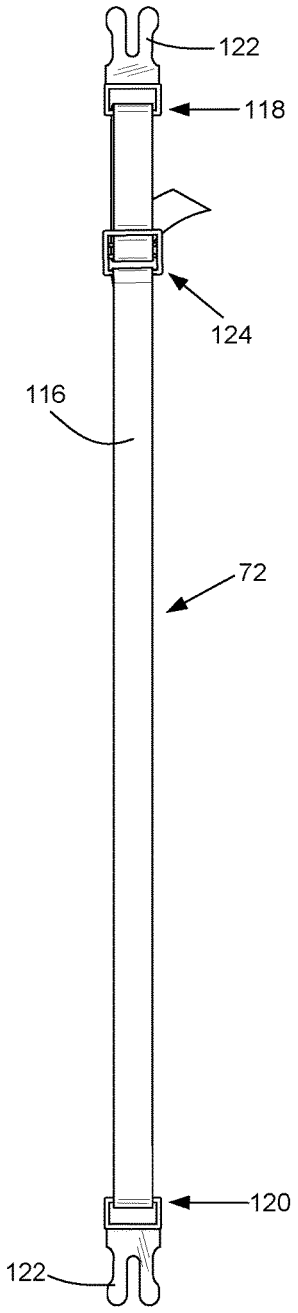
FIG. 9 is a front view of the support strap of the workout apparatus of FIG. 4.

In a preferred embodiment, the support strap 72 of the new workout apparatus 10 comprises an elongated support strap member 116 having a first end 118 and a second end 120 with a support strap connector 122 at each of the first end 118 and second end 120 of the support strap 72, as best shown in FIG. 9. As with the connecting strap 104, in a preferred configuration support strap member 116 is made out of a non-elastic material. A slider buckle 124 is utilized to allow the user to adjust the length of the support strap 72. The support strap 72 is sized and configured to go around (i.e., across the sides 42/44 and the front surface 34) the chair back 24 of the office chair 12, as best shown in FIG. 3, to hold the back plate assembly 66 in position against, preferably tightly against, the back surface 36 of the chair back 24, as shown in FIG. 2. In an alternative configuration, the support strap 72 can have one of the ends 118/120 of the support strap member 116 be integral with or fixedly attached to the one side edge 90/92 of the back plate 74 and the other end 118/120 have a support strap connector 122 that removably connects to the strap connector 76 at the other side edge 90/92 of the back plate 74. In another alternative configuration, support strap member 116 can be made out of an elastic material and both ends 118/120 thereof can be fixedly attached to the side edges 90/92. In this embodiment, the user 14 expands the support strap member 116 to fit it over the upper end 40 of the chair back 24 so the support strap member 116 will enclose tightly around the chair back 24.

Figure 10:
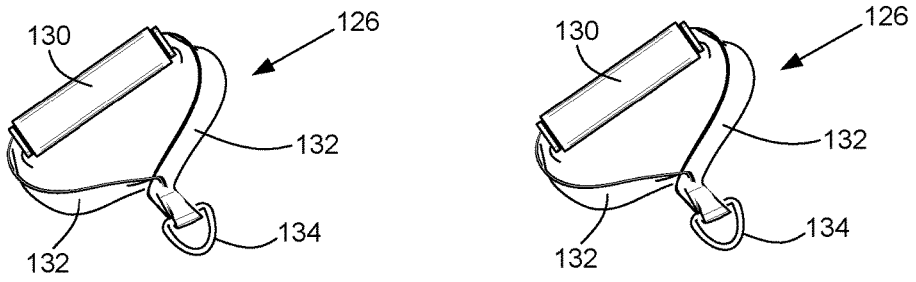
FIG. 10 is a side perspective view of the handles of the workout apparatus of FIG. 4.
Figure 12:
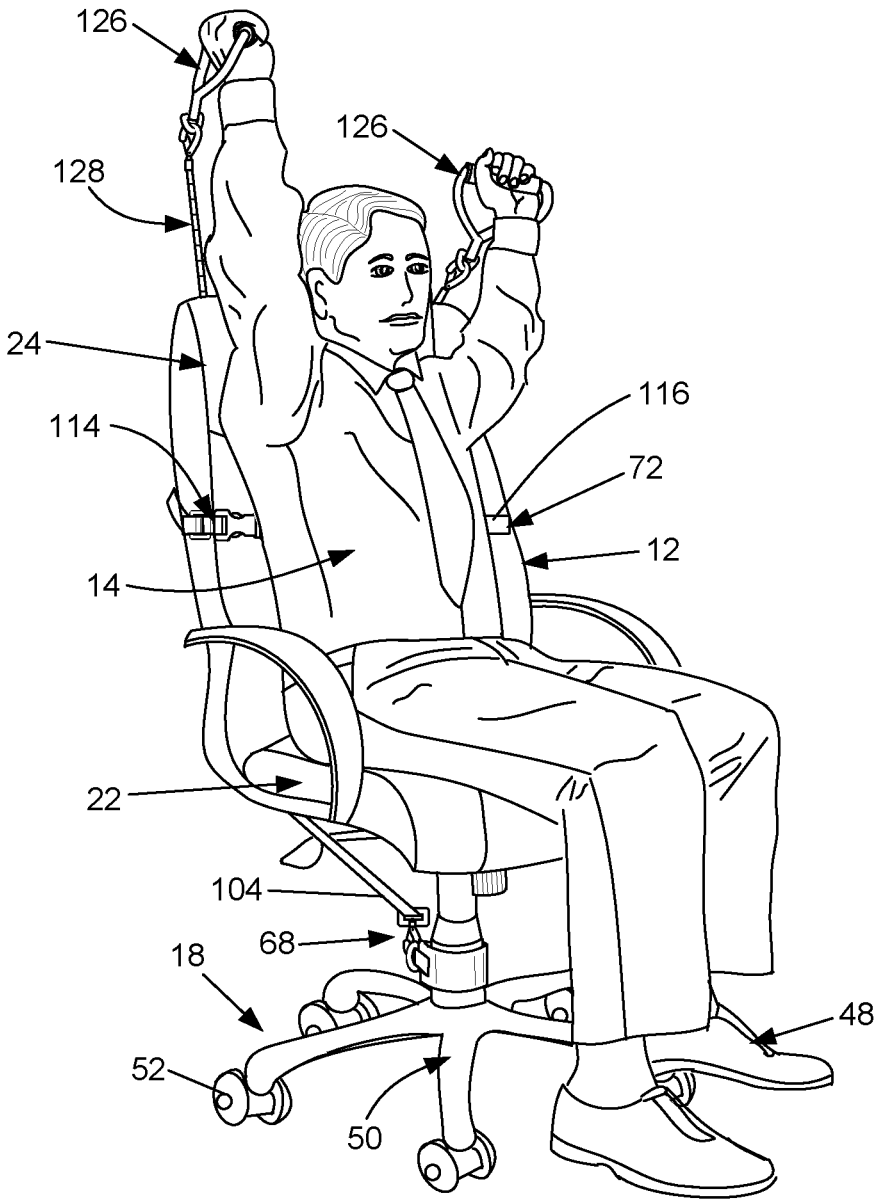
FIG. 12 is a front perspective view of a person sitting in the office chair of FIG. 1 having the workout apparatus of FIG. 4 attached thereto, with the person shown using the workout apparatus.

As set forth above, in a preferred configuration of the new workout apparatus 10, the mounting assembly 62 is structured and arranged to removably be secured to an office chair 10, the exercise components 64 are removably connected to the mounting assembly 62 and the user 14 utilizes the exercise components to exercise while he or she is sitting in the office chair 12, as shown in FIG. 12, whether or not he or she is working or engaged in other activities. In a preferred configuration of the workout apparatus 10 of the present invention, the exercise components 64 comprise a pair of handles 126 that are each integral with or attached (preferably removably attached) to a resistance band 128, as shown in FIG. 4. The handles 126 comprise a grip member 130 that is attached to one or more handle straps 132 that have a handle ring 134 for removably connecting to the resistance band 128, as best shown in FIG. 10. The configuration and use of handles such as the handles 126 shown in FIG. 10 for exercise equipment are well known in the art. The grip member 130 is sized and configured to be comfortably gripped by the user's hand. The grip member 130 can be made out of a wide range of materials, including plastic, wood, rubber, metal, composites and the like. In a preferred configuration, the handle strap 132 is a single strap member that is made out of a non-elastic material, such as the same material utilized for the support strap member 116. The handle ring 134, which is securely attached to the handle strap 132, is sized and configured to be engaged by the resistance band 128. In the embodiment shown in the figures, the handle ring 134 is a D-ring similar in size, shape and material to the connecting strap rings 78 and exercise connecting rings 80 utilized for the back plate assembly 66 and strap rings 96 utilized for the post strap assembly 68.

Figure 11:
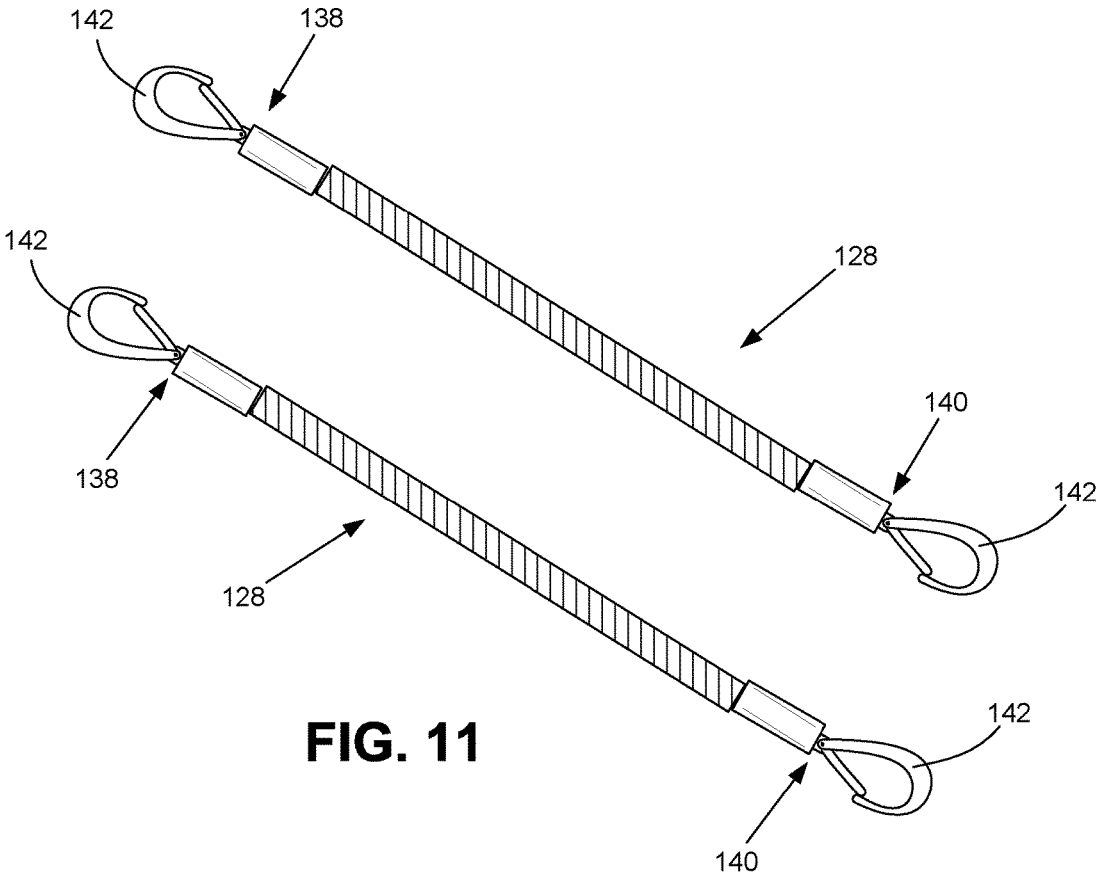
FIG. 11 is a top view of the resistance bands of workout apparatus of FIG. 4.

The resistance band 128 comprise an elongated resistance band member 136 having a first end 138 and a second end 140, with a resistance connector 142 at each of the first end 138 and second end 140, as best shown in FIG. 11. The configuration and use of resistance bands that can be utilized for resistance band 128 are well known in the exercise equipment art. The resistance band 128 can be provided in a wide variety of lengths and resistance level to accommodate different sizes of persons and/or the amount of resistance he or she may want when using the workout apparatus 10 to exercise while sitting in the office chair 10. The resistance connectors 142 at the ends 138/140 of the resistance band member 136 are selected to engage the handle rings 134 on the handles 126. The resistance connectors 142 can be the same type as the back plate connectors 110 and the post strap connectors 112 on the connecting strap assembly 70. Typically, the user 14 will be supplied with at least two resistance bands 128, as shown in FIGS. 2-4 and 11-13.

In use, the user 14 will attach the mounting assembly 62 to the office chair 12 and then attach the exercise components 64 to the mounting assembly 62. More specifically, the user 14 will position the post strap member 94 of the post strap assembly 68 around the center post 20 of the office chair 12 by connecting the post strap connector 112 of the connecting strap assembly 70 to the two strap rings 96 of the post strap assembly 68, as best shown in FIG. 4. The user 14 will then attach one of the support strap connectors 122 of the support strap 72 to one of the strap connectors 76 of the back plate assembly 66, place the back plate 74 against the back surface 36 of the chair back 24 and then extend the support strap member 116 around the chair back 24 to connect the other support strap connector 122 of the support strap 72 to engage the other strap connector on the back plate assembly 66. The user 14 then operates the slider buckle 124 of the support strap 72 to tighten the support strap member 116 around the chair back 24. Once the back plate assembly 66 is in position, the user then connects the two back plate connectors 110 of the Y-shaped connecting strap assembly 70 to the connecting strap rings 78 of the back plate assembly 66 to connect the back plate assembly 66 to the post strap assembly 68. The user then operates the slider buckles 114*a*/114*b* to tighten the connecting strap 104 between the back plate assembly 66 and the post strap assembly 68. If not already connected, the user connects a resistance connector 142 at one end 118/120 of the support strap member 116 to the handle ring 134 of the handle 126. This is repeated for the other handle 126. The user then connects the exercise components 64 to the mounting assembly 62 by connecting the other resistance connector 142 of one of the support straps 72 to one of the exercise connecting rings 80 of the back plate assembly 66 and connects the other resistance connector 142 of the other support trap 72 to a corresponding (i.e., at the top edge 84 or the opposite side edges 88/90 of the back plate 72)

exercise connecting ring 80, as shown in FIGS. 2 and 4. The new workout apparatus 10 is now ready for use.

To utilize the workout apparatus 10 of the present invention for exercise, the user 14 merely sits in the seating section 16 of the office chair 12, typically on the upper surface 28 of the chair seat 22 with his or her back against or near the front surface 34 of the chair back 24, as shown in FIG. 12. The user then reaches down to grasp the grip member 130 of the handle 126 and moves his or her arms to the general position necessary to accomplish the desired exercise. While gripping the grip member 130 of the handle 126, the user 14 then extends his or her arms upward, forward or outward against the resistance provided by the resistance band member 136 of resistance bands 128. As with other resistance band exercises, as the user 14 pulls against the resistance bands 128 and resists the biasing force provided by the resistance bands 128, he or she will be exercising his or her arms and improving his or her health and fitness. When the user 14 is done exercising he or she can leave the back plate assembly 66 and the post strap assembly 68 in place on the office chair and either store the exercise components 64 between the support strap 72 and the back surface 36 of the chair back 24 or disconnect the exercise components 64 from the back plate assembly 66 and place the exercise components 64 in a drawer or cabinet until he or she is ready to exercise again. Alternatively, the user 14 can remove the entire workout apparatus 10 from the office chair 12 and reinstall the workout apparatus 10 when he or she is ready to exercise again.

Figure 13:
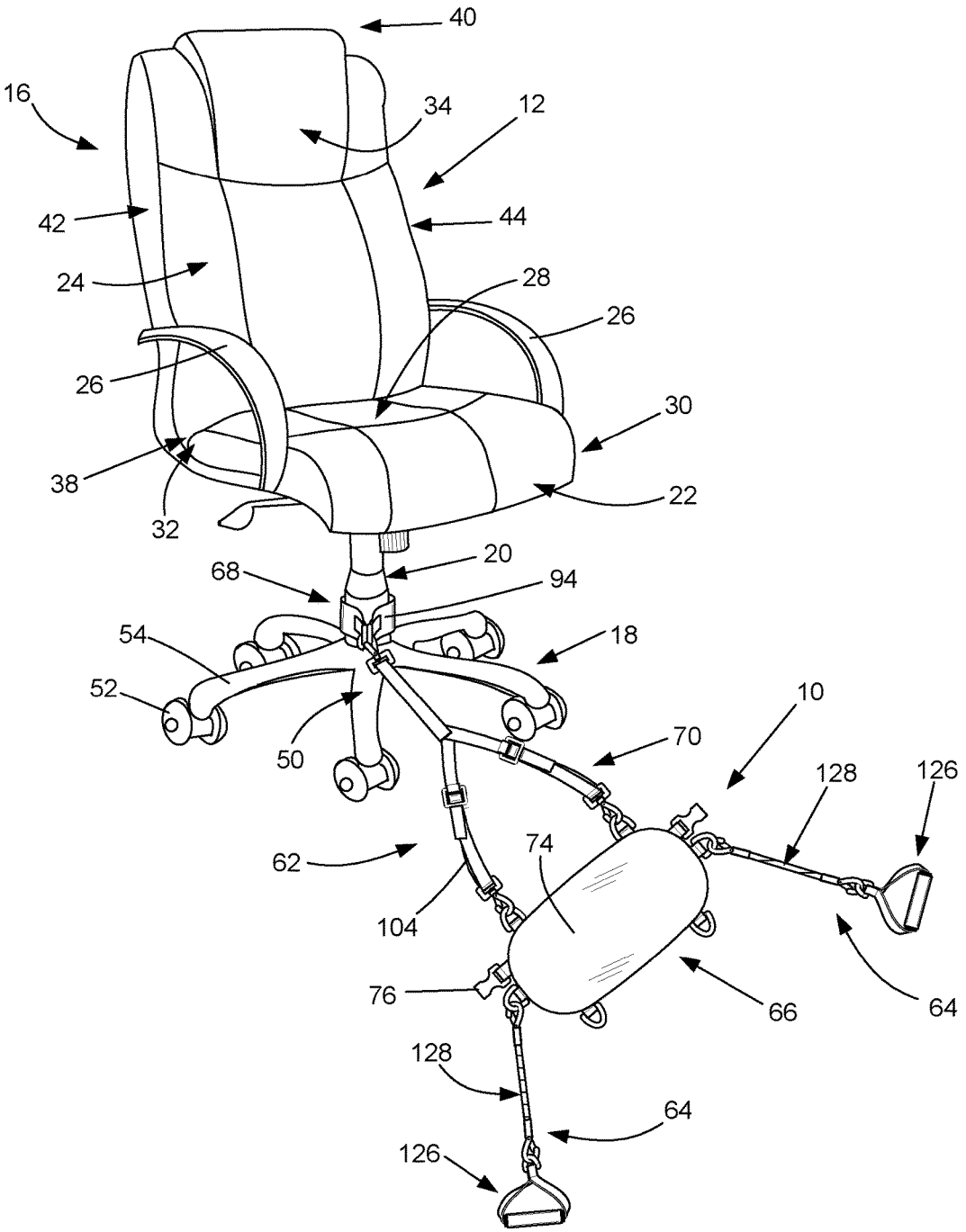
FIG. 13 is an alternative positioning if the workout apparatus of the present invention shown attached to the office chair but with the back plate shown on the ground to receive the user's feet to perform alternative exercises.

In another use of the workout apparatus 10 of the present invention, the user can disconnect the back plate assembly 66 from the chair back 24 of the office chair 12 and, with the post strap assembly 68 still attached to the center post 20 by the post strap connector 112 being connected to the strap rings 96 (as described above), place the back plate assembly 66 on the floor in front of the office chair 12 (i.e., below and in front of the front end 30 of the chair seat 22), as shown in FIG. 13. The user 14 then places his feet 48 on the back plate 74, grasps the grip member 130 of each handle 126 and lifts or pulls upward. With the back plate assembly 66 held in place by his or her feat, the user 14 will exercise his or her arms and other parts of his or her body while sitting in the office chair 12 due to the resistance provided by the resistance band members 136.

The new workout apparatus 10 of the present invention is able to provide the user 14 with the ability to exercise while he or she is sitting at his or her office chair 12. As will be readily appreciated by persons skilled in the art, the new exercise apparatus 10 is very lightweight and portable and it is not bulky so as to be discreet when attached to the office chair 12 and not interfere with the user 14 as he or she sits in the office chair 12 or moves the office chair 12 around his or her workstation. The new exercise apparatus 10 is easy to set up and effective at providing needed exercise for the use 14 as he or she is sitting in the office chair 12 (whether the office chair 12 is being used for work or not). As will be readily appreciated by persons who are skilled in the art, the new workout apparatus 10 is likely to be relatively inexpensive to manufacture, thereby allowing many office workers to take advantages of the benefits of the exercise that results from using the workout apparatus 10.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. A workout apparatus for use with an office chair having a seating section, a base and a center post interconnecting the seating section and the base; said workout apparatus comprising:

a mounting assembly structured and arranged to secure said workout apparatus to the office chair, said mounting assembly having a back plate assembly that is sized and configured to be positioned at a back surface of a chair back of the seating section, a post strap assembly that is sized and configured to be positioned at the center post, a connecting strap assembly that is sized and configured to connect said post strap assembly to said back plate assembly and a support strap that is sized and configured to secure said back plate assembly to the chair back of the seating section, said back plate assembly having a back plate with at least one connecting strap ring and said connecting strap assembly having a connecting strap with at least one back plate connector that is configured to engage said connecting strap ring so as to connect said connecting strap to said back plate; and one or more exercise components, each of said exercise components being attached to said mounting assembly so as to allow a user to exercise while sitting in the office chair, each of said exercise components comprising a handle attached to or integral with a resistance band.

2. The workout apparatus of claim 1, wherein said back plate assembly further comprises a back plate having one or more strap connectors, each of said strap connectors configured to be engaged by said support strap.

3. The workout apparatus of claim 2, wherein said support strap comprises an elongated support strap member and a support strap connector at an end of said support strap member, said support strap connector sized and configured in corresponding relation with said strap connector of said back plate assembly.

4. The workout apparatus of claim 3, wherein said back plate is flexible and said support strap is structured and arranged to place said back plate in abutting relation against the back surface of the chair back of the office chair.

5. The workout apparatus of claim 4, wherein said back plate has two of said strap connectors and said support strap has one of said support strap connector at each end of said support strap member, each one of said support strap connectors configured to engage one of said strap connectors to secure said back plate assembly and said support strap to the chair back of the office chair.

6. The workout apparatus of claim 1, wherein said connecting strap of said connecting strap assembly is y-shaped, said connecting strap assembly has at least two of said back plate connectors, and said back plate has at least two of said connecting strap rings.

7. The workout apparatus of claim 1, wherein said post strap assembly has an elongated post strap member that is sized and configured to encircle the center post of the office chair so as to be secured around the center post of the office chair.

8. The workout apparatus of claim 7, wherein said post strap assembly has a strap ring at each of a first end and a second end of said post strap member and said connecting strap assembly has a post strap connector that is structured and arranged to engage each of said strap rings to secure said post strap assembly around the center post of the office chair.

9. The workout apparatus of claim 1, wherein each of said resistance bands has an elongated resistance band member with a resistance connector at one end of said resistance band member to removably connect said resistance band member to said back plate assembly.

10. The workout apparatus of claim 9, wherein said back plate assembly comprises a back plate having at least one exercise ring sized and configured to removably connect to said resistance connector.

11. The workout apparatus of claim 10, wherein said back plate has a plurality of said exercise rings for connecting a plurality of resistance bands to said back plate assembly and each of said resistance band members has one of said resistance connectors at each end of said resistance band member to removably connect said resistance band to each of said handle and said back plate assembly.

12. A workout apparatus for use with an office chair having a seating section, a base and a center post interconnecting the seating section and the base; said workout apparatus comprising:

a mounting assembly structured and arranged to secure said workout apparatus to the office chair, said mounting assembly having a back plate assembly with a back plate that is sized and configured to be positioned at a back surface of a chair back of the seating section, a post strap assembly that is sized and configured to be positioned at the center post, a connecting strap assembly that is sized and configured to removably connect said post strap assembly to said back plate assembly and a support strap that is sized and configured to secure said back plate assembly to the chair back of the seating section, said back plate having at least one connecting strap ring and said connecting strap assembly having a connecting strap with at least one back plate connector that is configured to engage said connecting strap ring so as to connect said connecting strap to said back plate; and one or more exercise components, each of said exercise components removably attached to said mounting assembly to allow a user to exercise while sitting in the office chair, each of said exercise components comprising a handle attached to or integral with a resistance band having an elongate resistance band member.

13. The workout apparatus of claim 12, wherein said back plate has one or more strap connectors and said support strap comprises an elongated support strap member with a support strap connector at an end of said support strap member, each of said strap connectors being sized and configured in corresponding relation to said support strap connectors so as to be engaged by said support strap connectors to secure said back plate assembly and said support strap to said back plate.

14. The workout apparatus of claim 13, wherein said back plate is flexible and said support strap is structured and arranged to place said back plate in abutting relation against the back surface of the chair back of the office chair.

15. The workout apparatus of claim 13, wherein said back plate has two of said strap connectors and said support strap member has one of said support strap connectors at each end of said support strap member, each one of said support strap connectors configured to engage one of said strap connectors to secure said support strap to the chair back of the office chair.

16. The workout apparatus of claim 12, wherein said connecting strap of said connecting strap assembly is y-shaped, said connecting strap assembly has at least two of said back plate connectors, and said back plate has at least two of said connecting strap rings.

17. The workout apparatus of claim 12, wherein said post strap assembly has an elongated post strap member that is sized and configured to encircle the center post of the office chair and a strap ring at each of a first end and a second end of said post strap member, said connecting strap assembly having a post strap connector that is structured and arranged to engage each of said strap rings to secure said post strap assembly around the center post of the office chair.

18. A workout apparatus for use with an office chair having a seating section, a base and a center post interconnecting the seating section and the base; said workout apparatus comprising:

a mounting assembly structured and arranged to secure said workout apparatus to the office chair, said mounting assembly having a back plate assembly with a back plate that is sized and configured to be positioned at a back surface of a chair back of the seating section, a post strap assembly that is sized and configured to be positioned at the center post, a connecting strap assembly that is sized and configured to removably connect said post strap assembly to said back plate assembly and a support strap that is sized and configured to secure said back plate assembly to the chair back of the seating section, said back plate having one or more strap connectors and said support strap comprising an elongated support strap member with a support strap connector at each end of said support strap member, each of said strap connectors being sized and configured in corresponding relation to said support strap connectors so as to be engaged by said support strap connectors to secure said support strap to said back plate, said post strap assembly having an elongated post strap member that is sized and configured to encircle the center post of the office chair and a strap ring at each of end of said post strap member, said connecting strap assembly having a post strap connector that is structured and arranged to engage each of said strap rings so as to secure said post strap assembly around the center post of the office chair; and one or more exercise components, each of said exercise components removably attached to said mounting assembly to allow a user to exercise while sitting in the office chair, each of said exercise components comprising a handle attached to or integral with a resistance band having an elongate resistance band member.

19. A workout apparatus for use with an office chair having a seating section, a base and a center post interconnecting the seating section and the base; said workout apparatus comprising:

a mounting assembly structured and arranged to secure said workout apparatus to the office chair, said mounting assembly having a back plate assembly with a back plate that is sized and configured to be positioned at a back surface of a chair back of the seating section, a post strap assembly that is sized and configured to be positioned at the center post, a connecting strap assembly that is sized and configured to connect said post strap assembly to said back plate assembly and a support strap that is sized and configured to secure said back plate assembly to the chair back of the seating section, said post strap assembly having an elongated post strap member and a strap ring at each of a first end and a second end of said post strap member, said post strap member being sized and configured to encircle the center post of the office chair so as to be secured around the center post of the office chair, said connecting strap assembly having a post strap connector that is structured and arranged to engage each of said strap rings to secure said post strap assembly around the center post of the office chair; and one or more exercise components, each of said exercise components being attached to said mounting assembly so as to allow a user to exercise while sitting in the office chair, each of said exercise components comprising a handle attached to or integral with a resistance band.

20. The workout apparatus of claim 19, wherein said back plate has at least one connecting strap ring and said connecting strap assembly has a connecting strap with at least one back plate connector that is configured to engage said connecting strap ring so as to connect said connecting strap to said back plate, said connecting strap of said connecting strap assembly is y-shaped, said connecting strap assembly has at least two of said back plate connectors, and said back plate has at least two of said connecting strap rings.

* * * * *